US005346280A

United States Patent [19]

Deumite

[11] Patent Number: 5,346,280

[45] Date of Patent: Sep. 13, 1994

[54] CHAIR WITH AUTOMATIC STANDING AID

[76] Inventor: Norman A. Deumite, P.O. Box 83330, Baton Rouge, La. 70884-3330

[21] Appl. No.: 861,216

[22] Filed: Mar. 31, 1992

[51] Int. Cl.[5] ..... A47C 1/02

[52] U.S. Cl. ..... 297/330; 297/344.1; 297/DIG. 10

[58] Field of Search ..... 297/330, DIG. 10, DIG. 4, 297/344.1, 344.12, 344.15, 344.17; 180/907; 280/304.1

[56] References Cited

U.S. PATENT DOCUMENTS

| | | | |
|---|---|---|---|
| 2,824,597 | 2/1958 | Lerman | 180/907 X |
| 3,708,182 | 1/1973 | Markiel | 297/DIG. 10 X |
| 3,907,051 | 9/1975 | Weant et al. | 180/6.2 |
| 3,964,786 | 6/1976 | Mashuda | 297/330 |
| 4,067,249 | 1/1978 | Deucher | 297/330 |
| 4,119,164 | 10/1978 | Fogg, Jr. et al. | 180/6.5 |
| 4,231,614 | 11/1980 | Shaffer | 297/330 |
| 4,407,543 | 10/1983 | Mashuda | 297/330 |
| 4,456,086 | 6/1984 | Wier et al. | 180/11 |
| 4,581,778 | 4/1986 | Pontoppidan | 297/DIG 10 X |
| 4,623,194 | 11/1986 | Pillot | 297/448 X |
| 4,632,450 | 12/1986 | Holdt | 297/330 X |
| 4,809,804 | 3/1989 | Houston et al. | 180/65.5 |
| 4,884,841 | 12/1989 | Holley | 297/DIG. 10 X |

FOREIGN PATENT DOCUMENTS

| | | | |
|---|---|---|---|
| 2621244 | 4/1989 | France | 280/304.1 |
| 0776610 | 11/1980 | U.S.S.R. | 180/907 |

*Primary Examiner*—Kenneth J. Dorner
*Assistant Examiner*—Milton Nelson, Jr.
*Attorney, Agent, or Firm*—Millen, White, Zelano & Branigan

[57] ABSTRACT

A chair with an automatic standing aid and a wheelchair which incorporates these features are provided. These chairs can raise or lower an occupant automatically while compensating for the change in the center of gravity with stabilizers. The stabilizers allow the chairs to be lightweight, small in size, and independent of heavy supporting bases. The chairs can be used to replace those on existing wheelchair power bases.

27 Claims, 6 Drawing Sheets

CHAIR WITH AUTOMATIC STANDING AID

BACKGROUND OF THE INVENTION

The present invention is directed to chair with an automatic standing aid which can lift the operator into a standing position while he or she remains supported and also lower the operator back into a seated position. This function is referred to herein as a "stand-up" feature, and wheelchairs with such a feature are often referred to as "stand-up" wheelchairs.

The stand-up feature in the wheelchair provides the user with greater independence in that it enables him or her to do many activities within environments such as stores, residences, and places of work which cannot be done in the sitting position. This includes opening windows, removing objects from shelves, and operating appliances. Many other activities become more convenient with the greater field of view afforded by the standing position. Employment opportunities are broadened because many workplace modifications are no longer necessary where the wheelchair user has the ability to rise to a standing position. Money may be saved through less workplace and home modifications. Personal maintenance is also made easier for the wheelchair user in that dressing and personal hygiene are simplified. Social interaction is also improved with the stand-up feature in that the occupant may conduct eye-level conversions with companions, coworkers, merchants, etc. Many more leisure activities are possible and more enjoyable.

Standing has many physiological advantages for a person confined to a wheelchair, as well. It stimulates circulation, reduces bone decalcification and pressure sores, and helps with bladder training. Money may be saved with reduced health care and lower therapy costs.

Wheelchairs with a stand-up feature are known in the art and are commercially available. These wheelchairs must accommodate for the loss of the stability when these chairs are in the upright position. The stability of the wheelchair is reduced when the operator is lifted to the upright position because the center of gravity is raised and moved closer to the front axle. The stability of the stand-up wheelchair is defined as its ability to resist tipping over. The wheelchair may tip during a quick stop or start. Accordingly, some conventional stand-up wheelchairs do not move while the seat is in the upright position. Those wheelchairs which provide movement while the seat is in the upright position are large, very heavy, and require complex integration of the lift mechanism into its own heavy mobile power base to provide stability.

It is desirable to provide a wheelchair with a stand-up feature which is simple, light-weight and mobile in the upright position. It is also desirable to provide a chair with a lift mechanism for vertical support adaptable to existing mobile power bases which will enable motion in the upright position.

SUMMARY OF THE INVENTION

It is an object of the present invention to provide a chair with an automatic standing air which can be used on a variety of mobile power bases (trucks) or on a stationary support.

It is another object of the present invention to provide a chair with an automatic standing aid which allows for easy entrance and exit of the user which can be used on a mobile power base (truck) in the upright position.

It is another object of the present invention to provide a chair with an automatic standing aid which can be used as a replacement chair for existing mobile power bases.

It is another object of the present invention to provide a chair with an automatic standing aid which provides sufficient support for the operator in the upright position to accommodate for lack of control of the upper body.

It is an object of the present invention to provide a stand-up wheelchair with performance characteristics identical to those of conventional wheelchairs for a seated operator.

It is another object of the present invention to provide a stand-up wheelchair with dimensions which approximate those of conventional powered wheelchairs for a seated operator.

It is a further object of the present invention to provide a stand-up wheelchair which is stable and mobile in the upright position.

These and other objects will be apparent from the detailed disclosure and claims which follow. These objects are achieved in providing the chair with an automatic standing aid, as shown in FIG. 1.

The present invention provides a chair with an automatic standing aid which incorporates stabilizers that contact the ground in front of the chair when the occupant is raised to a standing position. The chair also comprises a mainframe, a framework of articulated linkage for raising and lowering the occupant, a drive means for raising and lowering this linkage, and a seat and seat-back combination to support the occupant. Means for supporting the lower body of the occupant when in the standing position is also included.

The stabilizers are articulated, pivotally anchored to the mainframe, and connected to the framework of articulated linkage so as to actuate and contact the ground when the framework of articulated linkage is completely raised. The stabilizers lift off the ground when the framework of articulated linkage is completely lowered. The stabilizers are positioned so as to contact the ground in front of the mainframe.

The present invention also provides a stand-up wheelchair which is mobile when the occupant is in the standing position. The stand-up wheelchair includes a mobile power base and the components of the chair with the automatic standing aid described above.

The stabilizers have wheels on the end to provide mobility when the occupant is in the standing position. In preferred embodiments, the mobile power base is interchangeable, and the stabilizers contact the ground at a point at least 2" from the center of gravity for the stand-up wheelchair with a 250-lb. occupant.

DETAILED DESCRIPTION OF THE PREFERRED EMBODIMENTS

Figure 1:
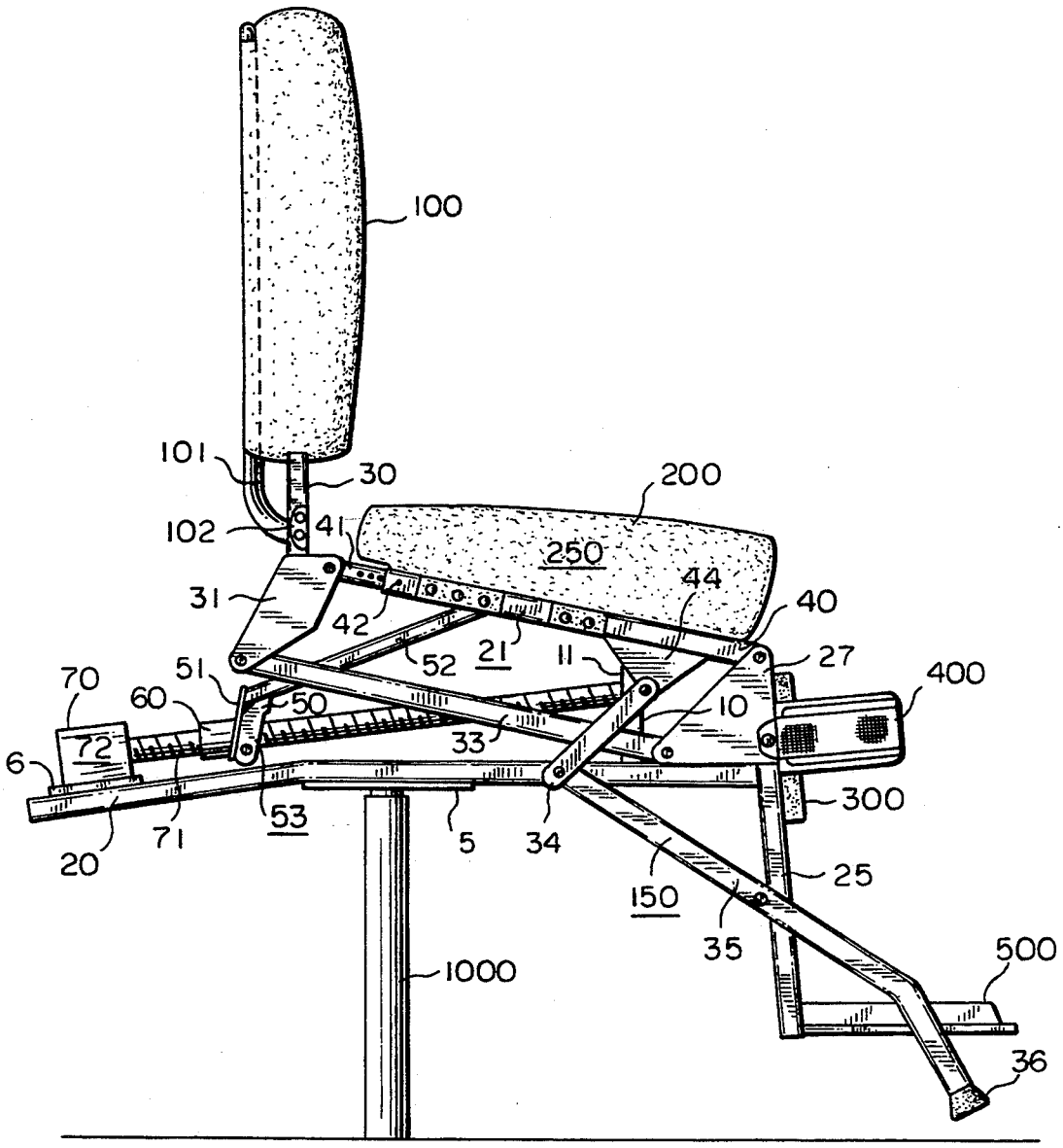
FIG. 1 is a side view of a chair with the standing aid of this invention in a partially raised position on a stationary base.

Referring to the drawings, where like reference numerals refer to similar parts, there is in FIG. 1 a chair with a standing aid of this invention shown on a stationary support 1000 which is not a component of the invention. A mainframe 20 is supported on the stationery base 1000 by a center post 5. The main frame 20 shown in FIG. 1 and FIGS. 5 and 6 additionally comprises pivot anchors 27, a plate 6, a bearing support 10, stabilizer anchors 26, and vertical supports 25. The main frame 20 supports a framework of articulated linkage 21 by pivot anchors 27.

The framework of articulated linkage 21 comprises a seat frame 40, two adjusting links 41, hinges 31, backrest rails 30, and lower linking arms 33. FIG. 1 shows only one of each component of the linkage. The complementary adjusting link 41, hinge 31, backrest rail 30, and lower linking arm 33 are positioned on the opposite side of the chair connected to another pivot anchor 27.

In the embodiment shown in FIGS. 1–4, a seat frame 40 is pivotally attached to the main frame 20 at the upper pivot points of pivot anchors 27. The adjusting links 51 are connected to the hinges 31 and are linked pivotally, preferably with nut and bolt. The hinges 31 are connected pivotally to lower linking arms 33, preferably by the same nut and bolt arrangement. The opposite end of the lower linking arms are connected to pivot anchors 27 at the lower pivot points. Various other configurations and components can be utilized.

A drive means 72 for automatically raising and lowering the framework of articulated linkage for the embodiment in FIG. 1 comprises a motor 70, a drive screw 71, a thrust bearing 11, a slider 60, and a coupler 53, which comprises a plate 51, mounts 50, and a push arm 52. The main frame 20 and drive means 72 are connected at a plate 6 and also at a bearing mount 10 for the thrust bearing 11. The plate 6 and bearing mount 10 also support drive means 72 in the embodiment shown in FIG. 1.

A seat and seat back combination 250 comprises a seat 200 and a backrest 100. The seat 200 is positioned on the seat frame 40, and the backrest 100 is supported by a backrest frame 101, which is mounted to the backrest rail 30 by a coupling 102.

The embodiment in FIG. 1 utilizes two articulated stabilizers 150, although only one is shown. Each articulated stabilizer 150 comprises a supporting leg 35, a connecting link 34, and a foot 36. The articulated stabilizers 150 are connected to the framework of articulated linkage 21 at mounting plates 44 of the seat frame 40 via a connecting link 34. A supporting leg 35 is pivotally anchored to the main frame 20 on vertical supports 25. Also shown in FIG. 1 is an optional leg pad 300, knee brace 400, and a footrest 500, all connected to the vertical support 25 of the main frame 20, which provide means for supporting the lower body when in the standing position. The knee brace 400 can comprise a simple strap or a more rigid brace such as a padded steel bracket.

Drive means 72 raises and lowers the framework of articulated linkage 21 as the motor 70 turns the drive screw 71 clockwise or counter-clockwise. The motor 70 can be AC or DC powered for the stationary chair and can be remotely controlled by the occupant or another. A slider 60 translates the circular motion of a drive screw 71 to move the coupler 53 up and down along the drive screw 71. The push arm 52 of the coupler 53 is connected to the seat frame 40 of the framework of articulated linkage 21 and pushes and pulls the seat frame 40 as the coupler 53 moves along the drive screw 71. The framework of articulated linkage 21 is raised and lowered with the pulling and pushing motion by the push arm 52 because of the pivotal connection to the main frame 20. It is preferable for the coupler 53 to swivel on the slider 60 so as to provide different force angles as the framework of articulated linkage is raised.

Figure 2:
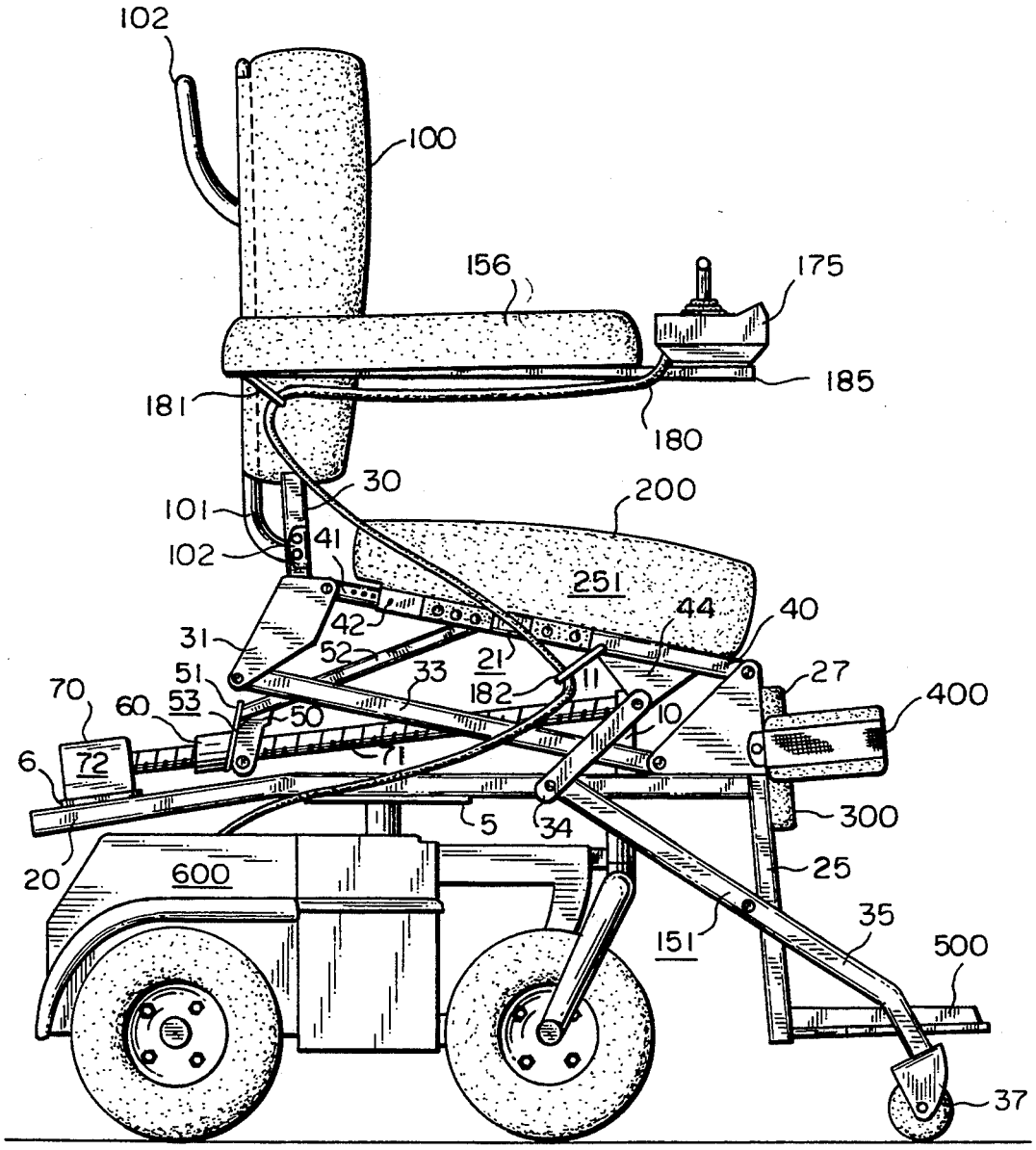
FIG. 2 is a side view of the stand-up wheelchair of this invention in a partially raised position.

Referring to FIG. 2, a stand-up wheelchair of the present invention is shown. The stand-up wheelchair has components similar to the chair with a standing aid shown in FIG. 1. A main frame 20 is identical and is supported by a mobile power base 600 instead of a stationary support. A framework of articulated linkage 21 is identical to that shown in FIG. 1. Drive means 72 and its connection to the main frame 20 are also identical to that shown in FIG. 1. The motor 70 is preferably DC powered to simplify mobility. Optional means for supporting the lower body of the occupant in the standing position is shown in FIG. 2 and comprises an identical leg pad 300, a knee brace 400, and footrest 500, as shown in FIG. 1, all supported by the frame member 25.

A seat and seat back combination 251 is similar to that of FIG. 1 and comprises a seat 200, a seat back 100, and a backrest frame 101. Optional push bar 102 and armrests 155 are shown in FIG. 2 as part of the seat and seat back combination. An optional controller 175 for the mobile power base and drive means are shown in FIG. 2 positioned off an armrest 155 on a bracket 185 with a control cable 180 supported by retaining springs 181 and 182.

Articulated stabilizers 151 are similar to that shown in FIG. 1. Each articulated stabilizer 151 comprises a supporting leg 35 pivotally anchored to a vertical support 25, a caster 37, and a connecting link 34. The caster 37 is positioned at the end of the supporting leg 35 to aid mobility. Articulated stabilizers 151 are connected to the framework of articulated linkage 21 at a mounting plate 44 via a connecting link 34.

Figure 3:
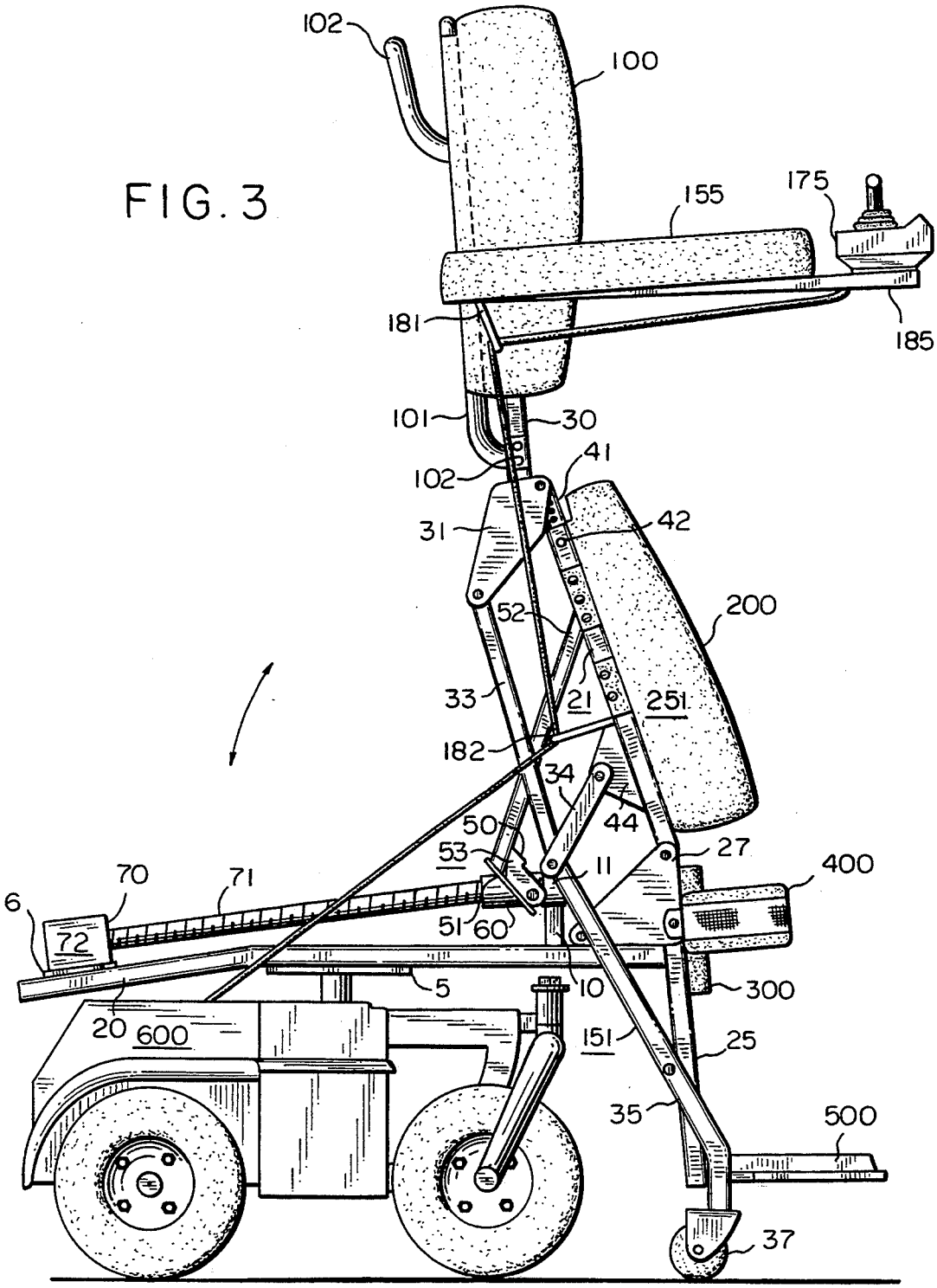
FIG. 3 is a side view of the stand-up wheelchair of this invention in the standing position.
Figure 4:
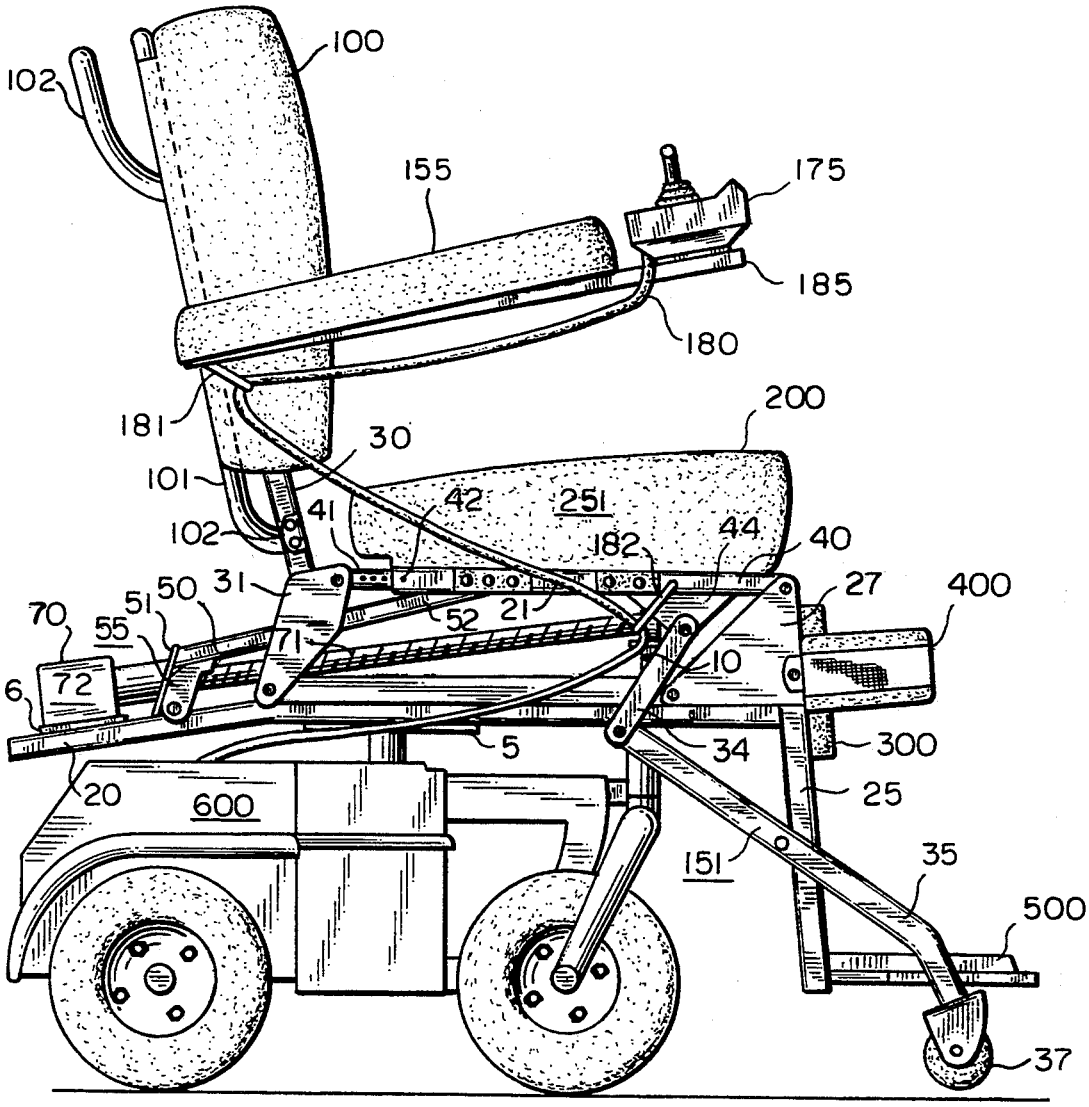
FIG. 4 is a side view of the stand-up wheelchair of this invention in a sitting position.

Referring to FIGS. 3 and 4, the stand-up chair of FIG. 2 is shown in different positions to illustrate the relative movement of the chair components. In FIG. 3, the articulated stabilizers 151 are actuated, the seat 200 is vertical, and the seat back 100 is raised. In FIG. 4, the articulated stabilizers are recoiled, the seat 200 is horizontal, and the seat back 100 is lowered.

Figure 5:
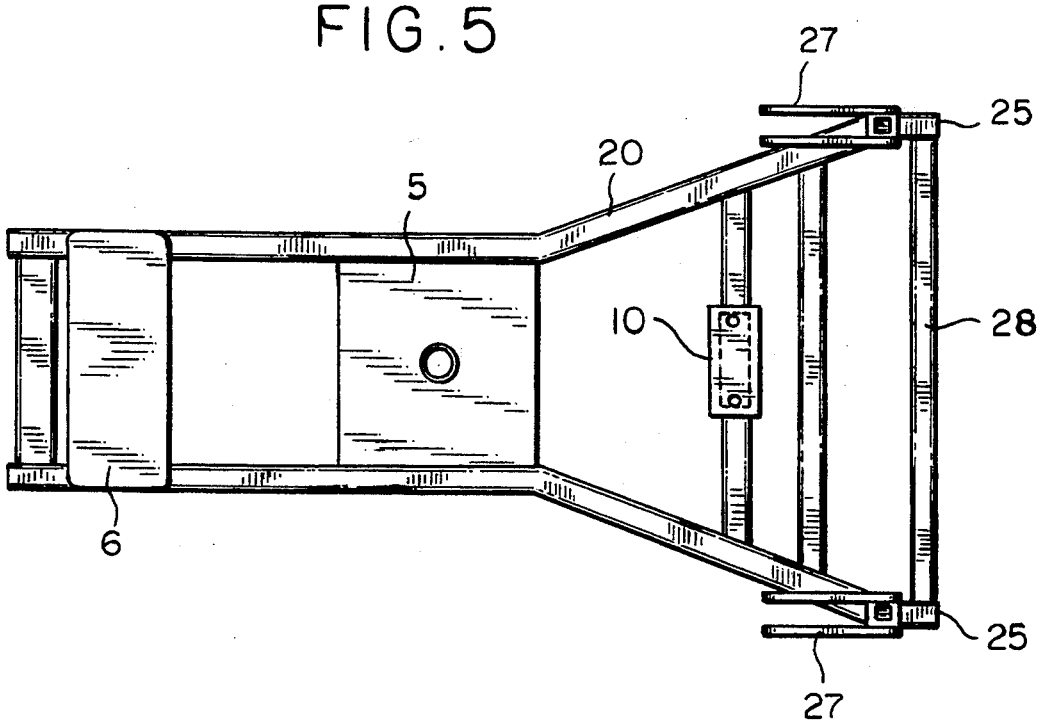
FIG. 5 is a top view of a mainframe which can be used in the chairs of this invention.
Figure 6:
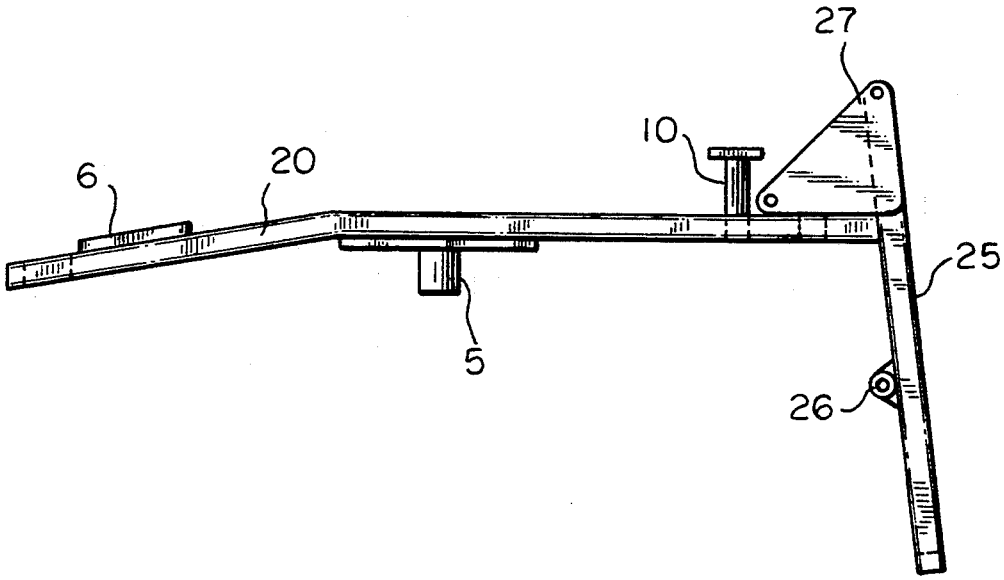
FIG. 6 is a side view of a mainframe which can be used in the chairs of this invention.

Referring now to FIGS. 5 and 6, main frame 20 is shown to better illustrate the components thereof. The center post 5 provides means for attaching the mainframe to a stationary or mobile support. The plate 6 provides means for connecting and supporting the drive means, together with the bearing support 10. In FIGS. 3 and 4, the plate 6 supports a motor 70, and a bearing support 10 supports a thrust bearing 11 and drive screw 71. Vertical supports 25 are fixed to pivot anchors 27 and stabilizer anchors 26. Pivot anchors 27 provide pivotal connection to the framework of articulated linkage. The stabilizer anchors 26 provide pivotal connection to articulated stabilizers.

The main frame 20 is intended to support all components of the chairs provided by this invention and to provide easy connection to a stationary support or an existing mobile base without interfering with the operation of said power base. Preferably, the main frame 20 is braced to prevent twisting during operation of the drive means. The dimensions and configurations of the mainframe are expected to vary with the power base and drive means utilized. One-inch box steel and ¾" flat iron have been found to be suitable in the configurations shown in FIGS. 5 and 6.

Figure 7:
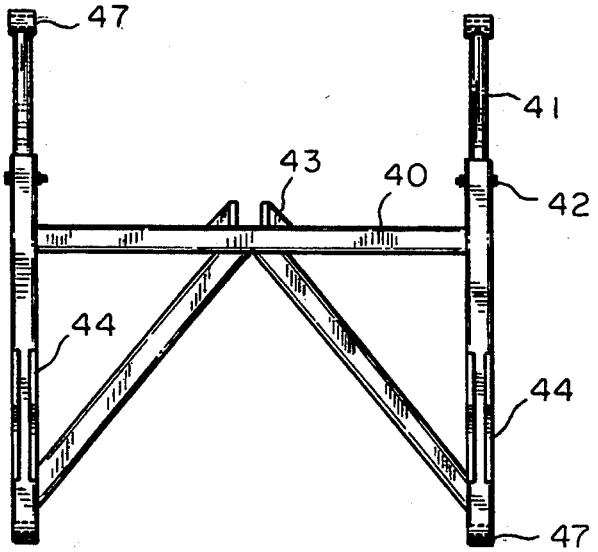
FIG. 7 is a top view of a seat frame which can be used as a component of the articulated linkage in the chairs of this invention.
Figure 8:
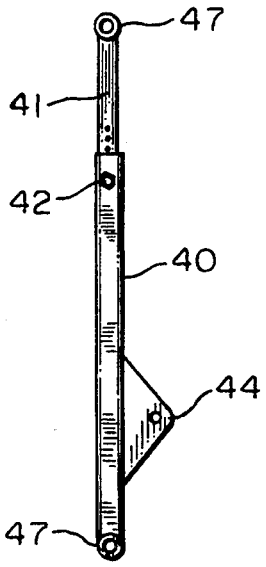
FIG. 8 is a top view of a seat frame which can be used as a component of the articulated linkage in the chairs of this invention.

Referring to FIGS. 7 and 8, a seat frame 40 is shown in greater detail. The seat frame 40 is a component of the framework of articulated linkage 21 shown in FIGS. 1–4. Adjusting links 41 serve to adjust the chair to the size of the occupant. A retaining bolt 42 locks the adjusting links 41 in place. Mounting plates 44 provide connection to the articulated stabilizers so as to translate the motion of raising and lowering the framework of articulated linkage to movement of the articulated stabilizers. The mounting plates 44 are fixed to the seat frame 40, preferably by welding. A mounting bracket 43 provides connection to a drive means such as the push arm 52 shown in FIGS. 1–4. The mounting bracket 43 is positioned to provide adequate leverage for the torque of the drive means to lift an occupant. Preferably, the seat frame 40 is braced to prevent twisting with the operation of the drive means. Connecting ends 47 of the seat frame 40 and adjusting links 41 are preferably reinforced in that these links provide pivotal connection to the main frame 20.

Figure 9:
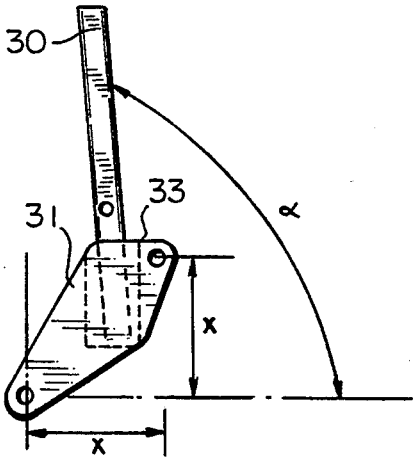
FIG. 9 is a side view of a backrest rail which can be used as a component of the articulated linkage in the chairs of this invention.
Figure 10:
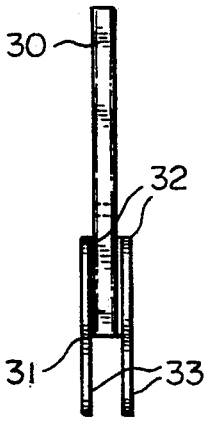
FIG. 10 is a front view of a backrest rail which can be used as a component of the articulated linkage in the chairs of this invention.

Referring to FIGS. 9 and 10, a hinge 31 and a backrest rail 30 are shown in greater detail. The hinge 31 comprises two spacer plates 32 used to provide adequate clearance for the reinforced couplings and two hinge plates 33. The backrest rail 30 is fixed firmly to the spacer plates 32 and the hinge plates 31, preferably by double welding. The angle $\alpha$ at which backrest 30 is connected to hinge 31 has an effect on the angle of inclination for the backrest. Adjustment of the seat linkage will also change the angle of inclination for the backrest. A preferred value for the angle $\alpha$ is 94 minutes where the values for X and X' are equal.

Figure 11:
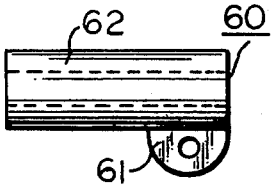
FIG. 11 is a side view of a slider of a slider-screw mechanism which can be used as a component of the drive means for raising and lowering the framework of articulated linkage in the chairs of this invention.
Figure 12:
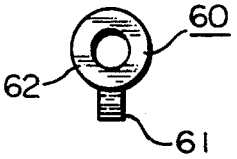
FIG. 12 is a front view of the slider of FIG. 11.
Figure 13:
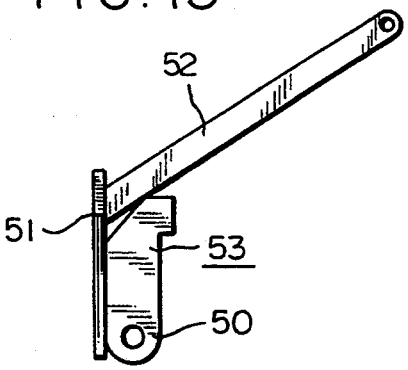
FIG. 13 is a side view of a coupling link which can be used as a component of the drive means for raising and lowering the framework of articulated linkage in the chairs of this invention.
Figure 14:
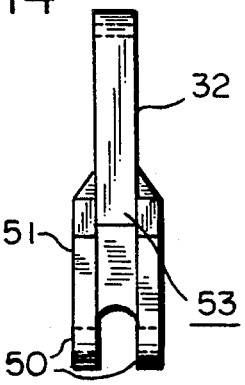
FIG. 14 is a side view of the coupling link of FIG. 13.

Shown in greater detail in FIGS. 11 and 12, a slider 60 comprises a tab 61 and a threaded nut 62. The tab 61 is preferably welded to the nut 62 so as to provide an anchoring means for the coupler 53. The coupler 53 is shown in greater detail in FIGS. 13 and 14 as comprising a push plate 51, a push arm 52, and two mounts 50. The push plate 51 is preferably welded to the mounts 50, which provide connection to the slider via tab 61 with a nut and bolt (not shown). The coupler 53 rotates on the bolt, which provides connection to the slider 60 so as to vary the angle of force applied by the push bar 52 as the slider moves on the screw 71. The push bar 52 is fixed to the push plate 51 but can be connected by a pivotal link.

The framework of articulated linkage raises and lowers the occupant into a sitting and standing position. The articulated framework is primarily used to provide different relative motion of the seat and seat back. Preferably, the seat back remains at a constant angle while the seat is lifted from a horizontal to a vertical position. While four bar linkage is shown in the figures, it should be recognized that a number of linkages can provide the desired motion for the seat back and seat. Preferably, the seat back and seat are moved parallel and in proportion to the movement of the body joints as the occupant is raised and lowered. The mechanism shown in FIGS. 1–4 provides sufficient relative motion for occupants of an average size. The relative motion of the seat back and seat can be attenuated by increasing the distance between the pivot points on hinges 31 and pivot members 27. Alternatively, the backrest can be configured so as to slide on the backrest as the occupant is raised and lowered. The articulated linkage is preferably lightweight and of a size which does not exceed the width and depth of a conventional seat so as not to limit access.

The seat is mounted to the framework of articulated linkage so as to be horizontal when the linkage is lowered and vertical when the framework of articulated linkage is raised. This is accomplished in the chairs shown in FIGS. 1–4 by simply attaching the seat 200 to the seat frame 40.

The seat back is attached to the framework of articulated linkage so as to remain substantially vertical as the framework of articulated linkage is raised and lowered. The term "vertical" as used herein is intended to include positions which are inclined of up to about 20°. As indicated above, the purpose of the articulated linkage is to provide differences in the relative motion of the seat and seat back. To obtain this difference in relative motion, the seat back can be anchored to a different component of the framework of articulated linkage. In the embodiments shown in FIGS. 1–4, a backrest rail 30 is welded to a hinge 31, which rotates counter-clockwise at the pivot points as the framework of articulated linkage 21 is raised, whereas the seat frame 40 rotates clockwise at the pivot points as the framework of articulated linkage 21 is raised.

Preferably, the seat back can be adjusted in height and angle of inclination. In the embodiment shown in FIG. 1, the height of the backrest 100 can be adjusted by positioning backrest frame 101 and coupling 102 on backrest rail 30. The angle of inclination can be adjusted by manipulating adjusting links 41 of the seat frame 40.

An optional feature of the chairs provided by this invention is a means for supporting the lower body of the occupant when in a standing position, preferably connected to the main frame or a component thereof. In the chairs shown in FIGS. 1 and 2, a leg pad 300, a knee brace 400, and a footrest 500 provide this function. However, alternative means, such as a waist strap or harness, can be used. The combination of a knee brace, leg pad, and footrest are preferred in that little or no adjustment is necessary in raising the occupant from the sitting to the standing position. Therefore, these elements can be connected to the main frame.

The drive means for automatically raising and lowering the framework of articulated linkage can vary widely. Drive means 72 in FIGS. 1–4 is a slider screw mechanism which is preferred in that it provides high torque at lower power requirements and is lightweight. The drive means can vary widely and includes different mechanisms such as pneumatic lifts. The drive means is preferably controlled by the occupant and is preferably operated by the same current source as the motors used to drive the mobile power base so that a converter is not needed.

The slider screw mechanism can have many configurations. In FIGS. 1–4, the end of the screw 71 is anchored by a thrust bearing 11 to provide the support which is needed to raise the articulated linkage with the occupant in the chair. The actual load on the screw 71 in FIGS. 1–4 can be about 900 lbs. due to the transmission angle. A thrust bearing is one of many means for anchoring the screw. The height of the thrust bearing 11 in the embodiments of FIGS. 1–4 determines the amount of torque needed to raise the framework of articulated linkage 21. The torque needed to start the motion of the framework of articulated linkage with a 250-lb. occupant is about 10 ft. lbs. in the embodiments of FIGS. 1–4.

A significant feature of the two chairs provided by this invention is one or more, preferably two, articulated stabilizers. The articulated stabilizer serves to accommodate a change in the center of gravity as the occupant is raised from a sitting to a standing position. The stabilizer provides contact with the ground at a point in front of the main frame to accomplish this function. The force at which the stabilizer touches the ground can vary widely, depending on the intended use of the chair. A light pressure may be exerted on the ground in a stand-up wheelchair, where an articulated stabilizer 151 serves only to prevent tipping when in motion while in a raised position. A chair with a standing aid is fixed to a stationary support, and the force applied to the ground by articulated stabilizers 150 may be quite high so as to provide added stability to the chair when the occupant is raised to the standing position.

The type and size of the caster 37 used in the articulated stabilizers 151 is determined by the force to be applied to the ground. FIGS. 2–4 show a caster 37 as a small wheel positioned at the end of the supporting leg 35, which is adequate to provide protection while the stand-up wheelchair is raised and in motion. A larger wheel may be desired to obtain additional support from the stabilizer. For example, a wheel of comparable size to that used in the power base shown in FIGS. 2–4 may be desired when actuation of the articulated stabilizers lifts the forward wheels of the power base off the ground.

A significant feature of the articulated stabilizer is that it is anchored to the main frame, preferably at only one point to minimize the number of moving parts. This allows the chair to be adaptable to many power bases. Preferably, the stabilizers remain independent of the power base and require no connection thereto. For the stabilizers to be effective, they typically must contact the ground at a point in front of the main frame.

In the embodiments of FIGS. 1–4, the articulated stabilizers are actuated when the framework of articulated linkage 21 is raised. The plates 44 lift connecting links 34, which causes the supporting legs 35 to pivot about the stabilizer anchors 26. The caster 37 or foot 36 then descends until it touches the ground. When the framework of articulated linkage 21 is lowered, plates 44 lower connecting links 34, and this motion is translated to the supporting legs 35 so as to lift the caster 37 or foot 36 off the ground. Preferably, the stabilizers contact the ground at a point forward of the center of gravity for the combination of the base, chair, and occupant. For most occupants, the center of gravity will be behind the main frame when the occupant is in a standing position.

For stand-up wheelchairs, the stabilizers preferably contact the ground at a point forward of the center of gravity for the unit with a 250-lb. occupant in the standing position. Most preferably, the stabilizers contact the ground at a point at least 2" forward of the center of gravity under these conditions. The further the stabilizers contact the ground forward from the center of gravity, the greater the stability; however, the benefits obtained are diminished if the stabilizer significantly increases the length of the unit, causing difficulties in transportation and maneuverability.

Preferably, the articulated stabilizers of the stand-up wheelchair can be adjusted to contact the ground at different distances. This will accommodate for different power bases and different-sized occupants. The articulated stabilizers 150 and 151 shown in FIGS. 1–4 are not adjustable. However, changing the position of the stabilizer anchor 26 on the vertical support 25, changing the length of the supporting leg 35, or changing the length of the connecting link 34 shown in FIGS. 1 and 2 will adjust the point of contact with the ground and/or the force applied to the ground by the stabilizer.

The chairs provided by this invention can include a number of optional features, one being means for supporting the upper body of an occupant in the standing position. This can include straps or a harness for the chest, arms, or abdomen. The chairs shown in FIGS. 1–4 do not show such straps, but FIGS. 2–4 do show optional armrests 150, which can assist in supporting the upper body.

Another optional component is a controller to operate the mobile power base, which is incorporated in the controller 175 shown in FIGS. 2–4 supported on a bracket 185. Preferably, this controller will adjust the maximum speed of the power base as the framework of articulated linkage is raised and lowered. A maximum speed of about 1 m.p.h. in the standing position is preferred, whereas conventional power bases typically provide maximum speeds of 8 m.p.h. in the sitting position. In preferred embodiments, the occupant is slightly reclined when in the standing position. This serves to provide support for the upper body and also places the center of gravity further back from the stabilizer when in a standing position. An angle of about 10° is preferred.

While the dimensions of the chairs of this invention are not critical, it is preferable that they do not restrict the capabilities of the power base. The chairs with standing aid of this invention can be lightweight, and typically a stand-up wheelchair of this invention is less than 250 lbs. The width of the chair is preferably less than 32" so as to fit through most doorways, and the height of the chair is preferably less than 48" when the framework of articulated linkage is in the lowered position so as to allow for easy transport in vans or automobiles. The chairs shown in FIGS. 1–4 meet these criteria and are also interchangeable on many power bases.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

The entire disclosure of all applications, patents, and publications, cited above and below, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A chair with an automatic standing aid which comprises:

a main frame adapted to be mounted on a supporting base;

a framework of articulated linkage mounted on said main frame so as to move an occupant into a standing position when raised and move an occupant into a sitting position when lowered;

a seat and seat back combination for supporting an occupant on said framework of articulated linkage, wherein said seat is mounted to said framework of articulated linkage so as to be horizontal when said framework of articulated linkage is lowered and vertical when said framework of articulated linkage is raised, said seat back being mounted to said articulated linkage so as to remain substantially vertical as the framework of articulated linkage is raised and lowered;

drive means for automatically raising and lowering the framework of articulated linkage mounted on said main frame and connected to said framework of articulated linkage; and at least one articulated stabilizer pivotally anchored to the main frame and connected to the framework of articulated linkage so as to contact the ground when the framework of articulated linkage is completely raised and lift off the ground when said framework of articulated linkage is completely lowered, wherein each stabilizer has a wheel attached to the end thereof which contacts the ground, wherein said stabilizer contacts the ground at a point in front of the main frame.

2. A chair as in claim 1, wherein the main frame is adapted to be mounted to a variety of mobile power bases.

3. A chair as in claim 3, wherein the articulated stabilizers are pivotally anchored at only one point on the main frame.

4. A chair as in claim 1, wherein the drive means is a powered slider screw, wherein the screw is mounted to the main frame, and the slider is connected to the framework of articulated linkage to translate motion to said framework of articulated linkage.

5. A chair as in claim 1, wherein the framework of articulated linkage is a parallel four-bar linkage which moves the seat and seat back parallel and in proportion to the movement of the body joints of an occupant.

6. A chair as in claim 1 having a width of less than 32", a weight of less than 250 lbs., and a height of less than 48" when the framework of articulated linkage is lowered.

7. A chair as in claim 1, which reclines an occupant in a standing position.

8. A chair as in claim 6, which reclines an occupant in a standing position sufficiently so that the seat back supports the upper body of the occupant.

9. A chair as in claim 1, which additionally comprises means for supporting the lower body of an occupant when in the standing position.

10. A chair as in claim 8, which additionally comprises means for supporting the upper body of an occupant when in the standing position.

11. A chair as in claim 9, wherein the means for supporting the lower body of an occupant in a standing position is a knee brace and footrest mounted on the main frame and the means for supporting the upper body comprises armrests connected to the seat back.

12. A stand-up wheelchair which comprises:

a mobile power base;

a main frame mounted to said mobile power base;

a framework of articulated linkage pivotally mounted on said main frame so as to move an occupant into a standing position when raised and move an occupant into a sitting position when lowered;

a seat and seat back combination for supporting an occupant on the framework of articulated linkage, wherein said seat is rigidly mounted to the framework of articulated linkage so as to be horizontal when said framework of articulated linkage is lowered and vertical when the framework of articulated linkage is raised, said seat back being pivotally mounted to said articulated linkage so as to remain substantially vertical as the framework of articulated linkage is raised and lowered;

drive means for automatically raising and lowering the framework of articulated linkage mounted on said main frame and said articulated linkage;

at least one articulated stabilizer having a wheel positioned at one end, wherein said articulated stabilizer is pivotally anchored to the main frame and connected to the framework of articulated linkage so that the wheel contacts the ground when the framework of articulated linkage is completely raised, and the wheel lifts off the ground when the framework of articulated linkage is completely lowered, wherein said wheel contacts the ground at a point in front of the main frame.

13. A stand-up wheelchair as in claim 12, which is mobile when an occupant is in the standing position and sitting position.

14. A stand-up wheelchair as in claim 12, which additionally comprises a controller to operate the mobile power base, wherein said controller automatically adjusts the maximum speed of the power base as the framework of articulated linkage is raised and lowered.

15. A stand-up wheelchair as in claim 14, which weighs less than 250 lbs.

16. A stand-up wheelchair as in claim 14, which has a width of less than 32" and a height of less than 48" when the framework of articulated linkage is lowered and a length of less than 48".

17. A stand-up wheelchair as in claim 14, wherein the mobile power base is directly connected only to the main frame.

18. A stand-up wheelchair as in claim 14, which reclines an occupant in a standing position.

19. A stand-up wheelchair as in claim 18, which reclines an occupant in a standing position sufficiently so that the seat back supports the upper body of the occupant.

20. A stand-up wheelchair as in claim 14, wherein the framework of articulated linkage is a parallel four-bar linkage which moves the seat and seat back parallel and in proportion to the movement of the body joints of an occupant.

21. A stand-up wheelchair as in claim 14, with two articulated stabilizers, each having a wheel positioned on an end, said articulated stabilizer being pivotally anchored on each side of the main frame, and each wheel contacts the ground at a point forward of the center of gravity for the stand-up wheelchair with a 250-lb. occupant.

22. A stand-up wheelchair as in claim 20, wherein each wheel contacts the ground at a point at least 2" forward of the center of gravity for the stand-up wheelchair with a 250-lb. occupant.

23. A stand-up wheelchair as in claim 20, wherein the articulated stabilizers are pivotally anchored at only one point on the main frame.

24. A stand-up wheelchair as in claim 22, wherein the means for supporting the lower body of an occupant in a standing position is a knee brace and footrest mounted on the main frame, and the means for supporting the upper body comprises armrests connected to the seat back.

25. A stand-up wheelchair as in claim 14, which additionally comprises means for supporting the lower body of an occupant in the standing position.

26. A stand-up wheelchair as in claim 25, which additionally comprises means for supporting the upper body of an occupant in the standing position.

27. A chair with an automatic standing aid which comprises:

a main frame adapted to be mounted on a supporting base by a center post;

a framework of articulated linkage mounted on said main frame so as to move an occupant into a standing position when raised and move an occupant into a sitting position when lowered;

a seat and seat back combination for supporting an occupant on said framework of articulated linkage, wherein said seat is mounted to said framework of articulated linkage so as to be horizontal when said framework of articulated linkage is lowered and vertical when said framework of articulated linkage is raised, said seat back being mounted to said articulated linkage so as to remain substantially vertical as the framework of articulated linkage is raised and lowered;

drive means for automatically raising and lowering the framework of articulated linkage mounted on said main frame and connected to said framework of articulated linkage; and at least one articulated stabilizer pivotally anchored to the main frame and connected to the framework of articulated linkage so as to contact the ground when the framework of articulated linkage is completely raised and lift off the ground when said framework of articulated linkage is completely lowered, wherein each stabilizer has a wheel attached to the end thereof which contacts the ground, wherein said stabilizer contacts the ground at a point in front of the main frame.

* * * * *